US011002414B2

(12) United States Patent
Takahashi et al.

(10) Patent No.: US 11,002,414 B2
(45) Date of Patent: May 11, 2021

(54) LIGHT SOURCE DEVICE

(71) Applicant: SHARP KABUSHIKI KAISHA, Sakai (JP)

(72) Inventors: Koji Takahashi, Sakai (JP); Karl Peter Welna, Oxford (GB)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/530,368

(22) Filed: Aug. 2, 2019

(65) Prior Publication Data

US 2020/0049317 A1 Feb. 13, 2020

Related U.S. Application Data

(60) Provisional application No. 62/716,481, filed on Aug. 9, 2018.

(51) Int. Cl.

| | |
|---|---|
| ***F21K 9/64*** | (2016.01) |
| ***F21K 9/68*** | (2016.01) |
| ***F21K 9/61*** | (2016.01) |
| ***F21S 41/176*** | (2018.01) |
| ***F21S 41/365*** | (2018.01) |
| ***F21S 41/40*** | (2018.01) |
| ***F21S 41/16*** | (2018.01) |
| ***F21S 45/70*** | (2018.01) |
| ***F21Y 115/30*** | (2016.01) |

(52) U.S. Cl.

CPC ..... *F21K 9/64* (2016.08); *F21K 9/61* (2016.08); *F21K 9/68* (2016.08); *F21S 41/16* (2018.01); *F21S 41/176* (2018.01); *F21S 41/365* (2018.01); *F21S 41/40* (2018.01); *F21S 45/70* (2018.01); *F21Y 2115/30* (2016.08)

(58) Field of Classification Search

CPC ..... F21S 45/00; F21S 45/70; F21S 41/176; F21S 41/13

See application file for complete search history.

(56) References Cited

U.S. PATENT DOCUMENTS

| | | | | |
|---|---|---|---|---|
| 9,109,771 | B2 | 8/2015 | Takahashi et al. | |
| 2011/0255835 | A1* | 10/2011 | Yagi | G02B 6/0038 385/129 |
| 2013/0003400 | A1 | 1/2013 | Kijima et al. | |
| 2013/0027962 | A1 | 1/2013 | Takahashi et al. | |

(Continued)

FOREIGN PATENT DOCUMENTS

| | | | |
|---|---|---|---|
| CN | 104075251 | A | 10/2014 |
| CN | 104838203 | A | 8/2015 |

(Continued)

*Primary Examiner* — Alexander K Garlen
*Assistant Examiner* — Colin J Cattanach
(74) *Attorney, Agent, or Firm* — ScienBiziP, P.C.

(57) ABSTRACT

[Object] External leakage of laser light can be prevented in a reflective type light source device.

[Solution] Laser light excites a first surface (21) of a phosphor light-emitting section. (20), and a window portion (30) formed of a transparent member disposed spaced away from the first surface (21) is provided. A light leakage prevention portion (600), which inhibits the laser light reflected at the first surface (21) of the phosphor light-emitting section (20) from leaking to the outside through the window portion (30) is provided to part of the window portion (30).

1 Claim, 9 Drawing Sheets

20: PHOSPHOR LIGHT-EMITTING SECTION
21: FIRST SURFACE
30: WINDOW PORTION
31, 332: ABSORPTION PORTION
534: SCATTERING PORTION
L2: REFLECTED LASER LIGHT

(56) References Cited

U.S. PATENT DOCUMENTS

| | | | | |
|---|---|---|---|---|
| 2013/0314937 | A1* | 11/2013 | Takahashi | F21S 41/16 362/538 |
| 2014/0286365 | A1 | 9/2014 | Ishikawa | |
| 2015/0062943 | A1* | 3/2015 | Takahira | F21S 41/285 362/510 |
| 2015/0330591 | A1 | 11/2015 | Adachi et al. | |
| 2018/0375001 | A1* | 12/2018 | Ueno | B60Q 11/005 |
| 2019/0323677 | A1* | 10/2019 | Bechtel | G01J 1/32 |
| 2019/0323678 | A1* | 10/2019 | Suzuki | F21V 23/004 |

FOREIGN PATENT DOCUMENTS

| | | | |
|---|---|---|---|
| JP | 2012-015001 | A | 1/2012 |
| JP | 2013-012358 | A | 1/2013 |
| JP | 5380498 | B2 | 1/2014 |
| JP | 5598974 | B2 | 10/2014 |
| JP | 2015-065144 | A | 4/2015 |
| JP | 2015-088283 | A | 5/2015 |
| JP | 5968682 | B2 | 8/2016 |
| JP | 2016-177923 | A | 10/2016 |

* cited by examiner

1: LIGHT PROJECTING UNIT
5: HOUSING
10: SEMICONDUCTOR LASER UNIT
15: COLLIMATOR LENS
16: CONCENTRATING LENS
20: PHOSPHOR LIGHT-EMITTING SECTION
21: FIRST SURFACE
30: WINDOW PORTION
31: ABSORPTION PORTION
100: LIGHT SOURCE DEVICE
110: PROJECTING MEMBER
L1: LASER LIGHT
L2: REFLECTED LASER LIGHT
L3: ILLUMINATION LIGHT

1: LIGHT PROJECTING UNIT
5: HOUSING
10: SEMICONDUCTOR LASER UNIT
15: COLLIMATOR LENS
16: CONCENTRATING LENS
20: PHOSPHOR LIGHT-EMITTING SECTION
21: FIRST SURFACE
30: WINDOW PORTION
31: ABSORPTION PORTION
100: LIGHT SOURCE DEVICE
110: PROJECTING MEMBER
L1: LASER LIGHT
L2: REFLECTED LASER LIGHT
E: EMISSION POINT

5: HOUSING
20: PHOSPHOR LIGHT-EMITTING SECTION
30: WINDOW PORTION
31: ABSORPTION PORTION
L2: REFLECTED LASER LIGHT
E: EMISSION POINT

20: PHOSPHOR LIGHT-EMITTING SECTION
30: WINDOW PORTION
31: ABSORPTION PORTION
201 LIGHT PROJECTING UNIT
210: PROJECTING MEMBER
L2: REFLECTED LASER LIGHT
E: EMISSION POINT

5: HOUSING
10: SEMICONDUCTOR LASER UNIT
15: COLLIMATOR LENS
16: CONCENTRATING LENS
20: PHOSPHOR LIGHT-EMITTING SECTION
30: WINDOW PORTION
110: PROJECTING MEMBER
300: LIGHT SOURCE DEVICE
301: LIGHT PROJECTING UNIT
331 (340): SPACED ABSORPTION PORTION
332: REFLECTING PORTION
L1: LASER LIGHT
L2: REFLECTED LASER LIGHT
L3: ILLUMINATION LIGHT

5: HOUSING
10: SEMICONDUCTOR LASER UNIT
15: COLLIMATOR LENS
16: CONCENTRATING LENS
20: PHOSPHOR LIGHT-EMITTING SECTION
30: WINDOW PORTION
110: PROJECTING MEMBER
300: LIGHT SOURCE DEVICE
301: LIGHT PROJECTING UNIT
331 (340): SPACED ABSORPTION PORTION
332: REFLECTING PORTION
335: HEAT EXHAUST MEMBER
336: BOTTOM SURFACE
L1: LASER LIGHT
L2: REFLECTED LASER LIGHT
L3: ILLUMINATION LIGHT

20: PHOSPHOR LIGHT-EMITTING SECTION
21: FIRST SURFACE
30: WINDOW PORTION
431: ABSORPTION PORTION
433: LIGHT GUIDE PORTION

FIG. 8

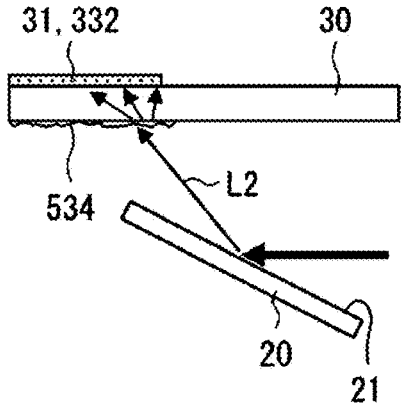

20: PHOSPHOR LIGHT-EMITTING SECTION
21: FIRST SURFACE
30: WINDOW PORTION
31, 332: ABSORPTION PORTION
534: SCATTERING PORTION
L2: REFLECTED LASER LIGHT

FIG. 9

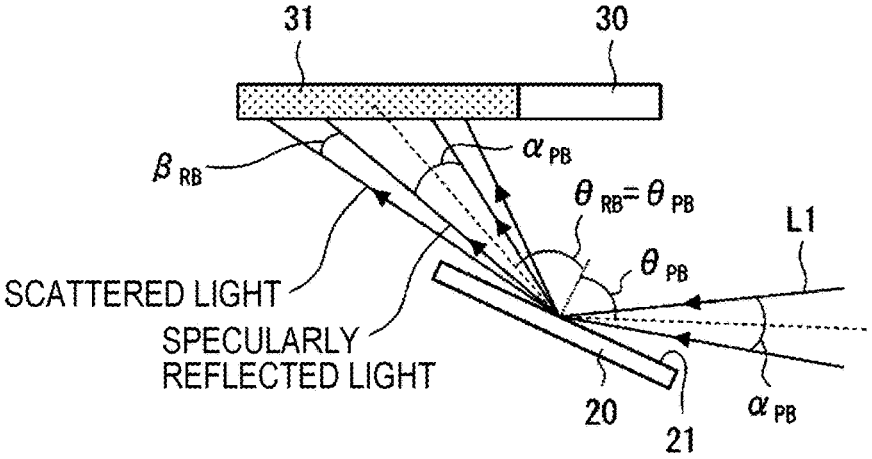

20: PHOSPHOR LIGHT-EMITTING SECTION
21: FIRST SURFACE
30: WINDOW PORTION
31: ABSORPTION PORTION
L1: LASER LIGHT
$\theta_{PB}$: INCIDENT ANGLE OF EXCITATION LIGHT
$\theta_{RB}$: INCIDENT ANGLE OF REFLECTED LIGHT
$\alpha_{PB}$: DIVERGENCE ANGLE OF EXCITATION LIGHT
$\alpha_{RB}$: DIVERGENCE ANGLE OF REFLECTED LIGHT
$\beta_{RB}$: DIVERGENCE ANGLE DUE TO SURFACE SCATTERING

LIGHT SOURCE DEVICE

TECHNICAL FIELD

The present invention relates to a light source device.

BACKGROUND ART

There has been advance in recent years regarding a technique where a member containing phosphor material is excited by laser light emitted from a semiconductor laser element, thereby yielding a white or monochromatic high-luminance light source. For example, white high-luminance high-luminous-flux light sources have been put into practical use as light sources for laser headlamps.

The technique described in PTL 1 enables a white light source unit and a light projecting unit that projects white light emitted from the white light source unit to be separated. Also, the technique described in PTL 2 has a configuration where a white light source unit is protected by a transparent window, and laser light is reflected once at the window portion and then excites a phosphor light-emitting section. The configurations disclosed in PTL 1 and PTL 2 are excellent from the point that the white light source and light projecting unit are separately prepared, can be independently designed and manufactured, and in a case where one of the white light source and light projecting unit malfunctions, the one alone can be easily replaced.

On the other hand, there are a configuration referred to as a reflective type and a configuration referred to as a transmissive type, as excitation methods for exciting a phosphor light-emitting section by laser light. In the reflective type, a first surface of the phosphor light-emitting section is irradiated with excitation laser light, and light emission (fluorescence) at the phosphor light-emitting section is mainly extracted from the same first surface. In the reflective type, a second surface of the phosphor light-emitting section often is in contact with a non-transparent reflecting material such as metal or the like, or a heat sink.

In the transmissive type, a first surface of a phosphor light-emitting section is irradiated with excitation laser light, and light emission (fluorescence) is mainly extracted from a second surface that is a surface on the rear side from the first surface. There are cases in the transmissive type where a transparent heat sink that transmits light is provided on the first surface or second surface of the phosphor light-emitting section.

Both the reflective type and transmissive type have a common problem, in that part of the laser light emitted for excitation of the phosphor light-emitting section exhibits specular reflection (also referred to as regular reflection) with the laser light being not completely absorbed at the phosphor light-emitting section. Particularly, in the case of the reflective type, the direction of specular reflection of the laser light is the same as the direction of extracting fluorescence, so there is a problem that specularly-reflected laser light becomes stray light and is externally emitted, or becomes mixed with the fluorescence and causes unevenness in the color distribution of the fluorescence (e.g., see PTL 3 and PTL 4).

Several measures have been proposed as configurations to keep laser light that has been specularly reflected in such reflective type configuration from being externally emitted (e.g., see PTL 5 and PTL 6). These techniques disclose configurations where laser light that has been specularly reflected at a phosphor light-emitting section is returned to the phosphor light-emitting section by a concave mirror or a flat mirror.

CITATION LIST

Patent Literature

[PTL 1] U.S. Pat. No. 9,109,771 Specification

[PTL 2] Japanese Unexamined Patent Application Publication No. 2015-065144

[PTL 3] Japanese Patent No. 5,380,498

[PTL 4] Japanese Patent No. 5,598,974

[PTL 5] Japanese Unexamined Patent Application Publication No. 2013-12358

[PTL 6] Japanese Unexamined Patent Application Publication No. 2012-15001

SUMMARY OF INVENTION

Technical Problem

However, a configuration where laser light that has been specularly reflected at the phosphor light-emitting section is returned to the phosphor light-emitting section by a concave mirror or a flat mirror requires an additional optical system member, which has necessitated excessive layout space and disposing of additional optical parts. On the other hand, in the configuration where the light source and light projecting unit are configured independently and the window portion is used, the spacing between the phosphor light-emitting section and the window portion preferably is narrow, in order to improve usage efficiency of light emitted from the phosphor light-emitting section. Accordingly, providing space for disposing optical system members to return laser light that has been specularly reflected at the phosphor light-emitting section to the phosphor light-emitting section has not been a preferable configuration.

An aspect of the present invention has been made in light of the above-described circumstances, and provides a technique that can prevent external leakage of laser light in a reflective type light source device.

Solution to Problem (1) An embodiment of the present invention is a light source device, including a semiconductor laser unit and a phosphor light-emitting section excited by laser light emitted from the semiconductor laser unit. The laser light excites a first surface of the phosphor light-emitting section. A window portion formed of a transparent member is provided spaced away from the first surface. A light leakage prevention portion, which inhibits the laser light reflected at a surface of the phosphor light-emitting section from externally leaking through the window portion, is provided to part of the window portion.

(2) Also, an embodiment of the present invention is a light source device, including a semiconductor laser unit and a phosphor light-emitting section excited by laser light emitted from the semiconductor laser unit. The laser light excites a first surface of the phosphor light-emitting section. A window portion formed of a transparent member is provided spaced away from the first surface. An absorption portion, which absorbs the laser light reflected at a surface of the phosphor light-emitting section, is provided to part of the window portion.

(3) Also, in an embodiment of the present invention, in addition to the configuration of the above (2) of the light source device, the absorption portion is integrally molded with another part of the window portion.

(4) Also, in an embodiment of the present invention, in addition to the configuration of the above or (3) of the light source device, the absorption portion includes a light absorbing matter inside part of the window portion.

(5) Also, in an embodiment of the present invention, in addition to the configuration of the above (2) of the light source device, the absorption portion includes a light absorbing layer provided on a surface of part of the window portion.

(6) Also, an embodiment of the present invention is a light source device, including a semiconductor laser unit and a phosphor light-emitting section excited by laser light emitted from the semiconductor laser unit. The laser light excites a first surface of the phosphor light-emitting section. A window portion formed of a transparent member is provided spaced away from the first surface. A reflecting portion, which reflects the laser light reflected at a surface of the phosphor light-emitting section, is provided to part of the window portion.

(7) Also, in an embodiment of the present invention, in addition to the configuration of the above (6) of the light source device, the reflecting portion includes a reflecting layer provided on a surface of part of the window portion.

(8) Also, in an embodiment of the present invention, in addition to the configuration of either the above (6) or (7) of the light source device, the light source device further includes an absorption portion that absorbs the laser light reflected at the reflecting portion.

(9) Also, in an embodiment of the present invention, in addition to the configuration of either the above (6) or (7), the light source device further includes a photoreceptor that receives the laser light reflected at the reflecting portion, and performs photoelectric conversion of the received light.

(10) Also, an embodiment of the present invention is light source device, including a semiconductor laser unit and a phosphor light-emitting section excited by laser light emitted from the semiconductor laser unit. The laser light excites a first surface of the phosphor light-emitting section. A window portion formed of a transparent member is provided spaced away from the first surface. A light guide portion, which guides the laser light reflected at a surface of the phosphor light-emitting section, is provided to part of the window portion.

(11) Also, in an embodiment of the present invention, in addition to the configuration of the above (10) of the light source device, the light guide portion has a reflecting layer provided on a front surface and a rear surface of part of the window portion.

(12) Also, in an embodiment of the present invention, in addition to the configuration of either the above (10) or (11), the light source device further includes an absorption portion, which absorbs light guided by the light guide portion, at an end portion of part of the window portion.

(13) Also, an embodiment of the present invention is a light source device, including a semiconductor laser unit and a phosphor light-emitting section excited by laser light emitted from the semiconductor laser unit. The laser light excites a first surface of the phosphor light-emitting section. A window portion formed of a transparent member is provided spaced away from the first surface. A scattering portion, which scatters the laser light reflected at a surface of the phosphor light-emitting section, is provided to part of the window portion.

(14) Also, in an embodiment of the present invention, in addition to the configuration of the above (13) of the light source device, the scattering portion has a scattering structure on a surface of part of the window portion that faces the first surface of the phosphor light-emitting section, and has a reflecting structure that reflects the laser light on another surface of part of the window portion.

(15) Also, in an embodiment of the present invention, in addition to the configuration of the above (13) of the light source device, the scattering portion has a scattering structure on a surface of part of the window portion that faces the first surface of the phosphor light-emitting section, and has an absorbing structure that absorbs the laser light on another surface of part of the window portion.

(16) Also, in an embodiment of the present invention, in addition to the configuration of the above (13) of the light source device, the scattering portion has a ground-glass-like structure provided on a surface of part of the window portion.

(17) Also, in an embodiment of the present invention, in addition to the configuration of the above (13), the scattering portion has a scattering layer provided on a surface of part of the window portion.

Advantageous Effects of Invention

According to an aspect of the present invention, external leakage of laser light can be prevented in a reflective type light source device.

BRIEF DESCRIPTION OF DRAWINGS

FIG. 8 is a partial enlarged view illustrating a schematic configuration of a window portion and a phosphor light-emitting section according to Embodiment 4.

FIG. 9 is a diagram illustrating spreading of laser light that has been specularly reflected at the surface of the phosphor light-emitting section, due to surface scattering.

DESCRIPTION OF EMBODIMENTS

Embodiment 1

Embodiment 1 of the present invention will be described in detail below.

[Overview of Light Projecting Unit 1]

Figure 1:
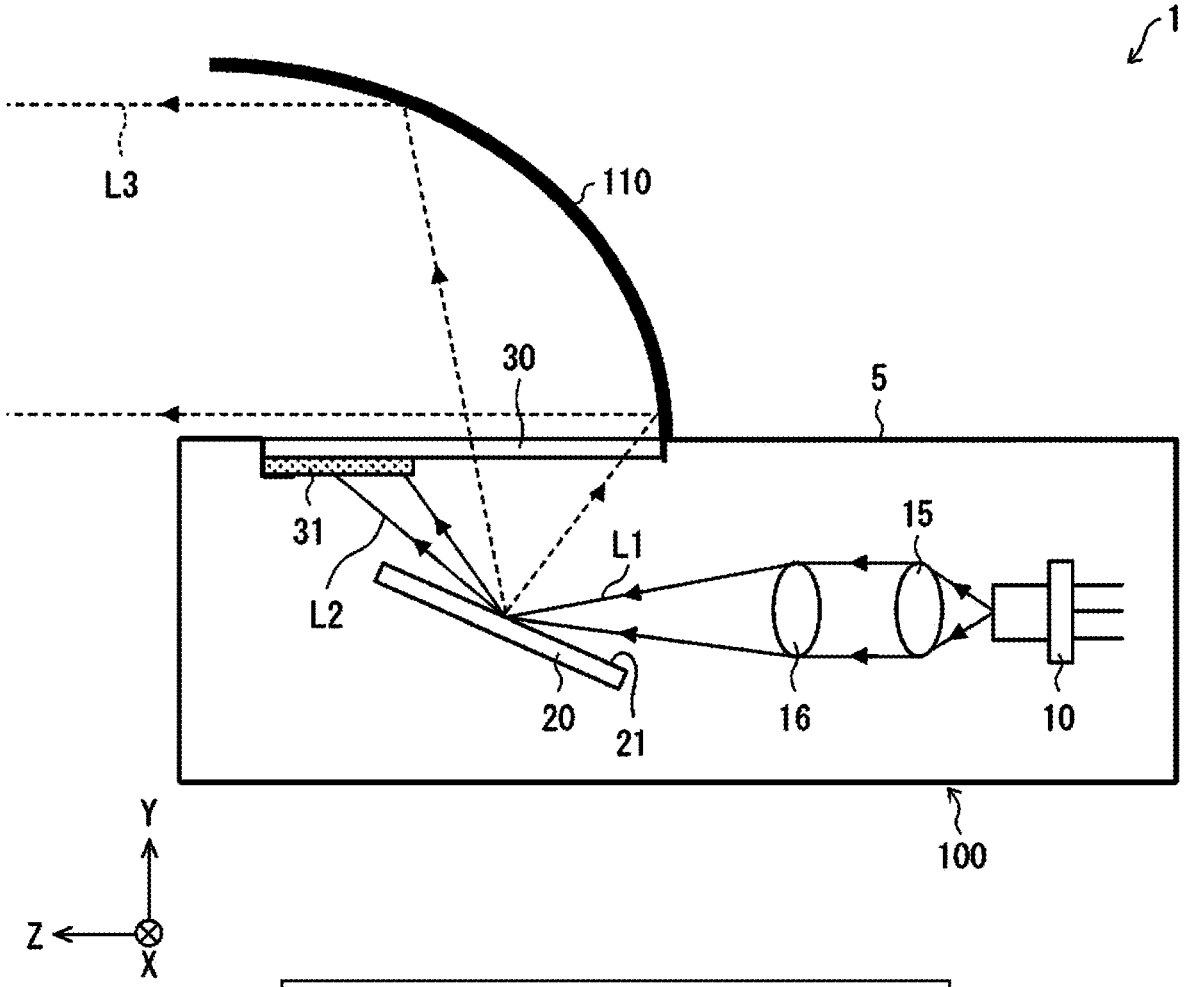
FIG. 1 is a side sectional view illustrating a schematic configuration of a light projecting unit according to Embodiment 1.

FIG. 1 is a diagram schematically illustrating an overview configuration of a light projecting unit 1 according to the present embodiment, and is a side sectional view where a section of the light projecting unit 1 is viewed from the side (X direction in FIG. 1). The light projecting unit 1 can be used for a laser headlamp of a vehicle, for example.

The light projecting unit 1 has a light source device 100 and a projecting member 110, as illustrated in FIG. 1. The light source device 100 and projecting member 110 have a separable configuration in the light projecting unit 1. The projection pattern of the light projecting unit 1 can be changed by replacing the projecting member 110. Note that the projecting member 110 is a reflector that projects incident light forward (Z direction in FIG. 1).

The light source device 100 has a semiconductor laser unit 10 and a phosphor light-emitting section 20. The semiconductor laser unit 10 is a blue semiconductor laser in the present embodiment. The light source device 100 also has a lens system including a collimator lens 15 and a concentrating lens 16 for collecting light emitted from the semiconductor laser unit 10 at an emission point F (see FIG. 2) of the phosphor light-emitting section 20.

The phosphor light-emitting section 20 is a plate-shaped member containing a phosphor material. The phosphor light-emitting section 20 is excited by laser light L1 emitted from the semiconductor laser unit 10 and collected at the emission point E by the collimator lens 15 and concentrating lens 16. The surface of the phosphor light-emitting section 20 at the side excited by the laser light L1 will be referred to as the surface or first surface.

The light source device 100 is configured by the semiconductor laser unit 10, collimator lens 15, concentrating lens 16, and phosphor light-emitting section 20 being accommodated in a housing 5. A window portion 30 is provided to the housing 5. Light excited by the phosphor light-emitting section 20 is extracted to the outside of the housing 5 from the window portion 30.

The window portion 30 is configured of a member that has high transmissivity as to white light. The window portion 30 can be configured of various types of crystalline or non-crystalline members, such as glass, sapphire, plastic, and so forth, for example. Light emitted from the semiconductor laser unit 10 that is blue semiconductor laser excites the phosphor light-emitting section 20, fluorescence generated by excitation and scattered components of blue laser light are mixed and extracted from the window portion 30 as white light, and become white illumination sight projected forward (Z direction in FIG. 1) by the projecting member 110.

Figure 2:
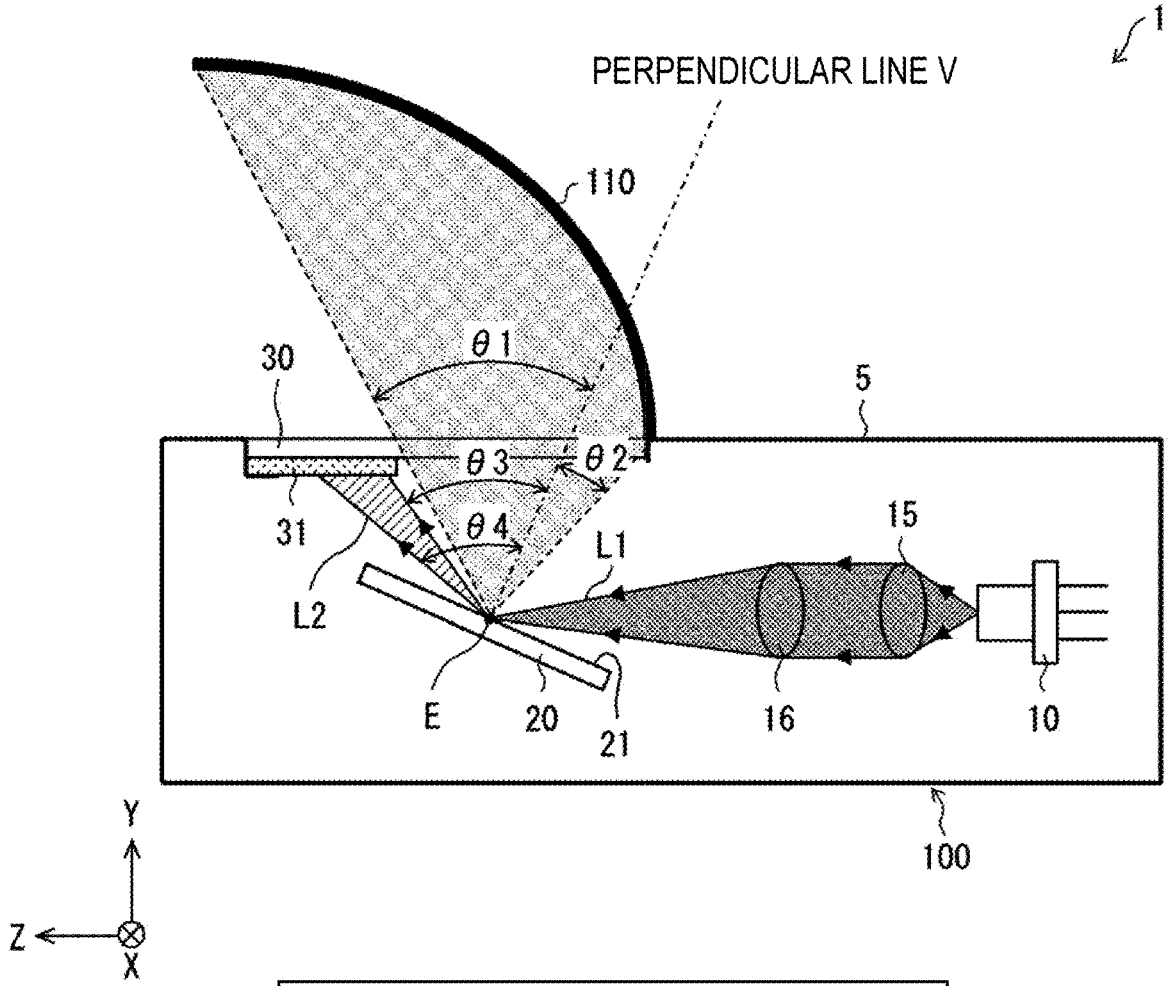
FIG. 2 is a side sectional view of the light projecting unit.

Now, when the phosphor light-emitting section 20 is irradiated with the laser light L1, three types of light rays are generated from the surface of the phosphor light-emitting section 20. FIG. 2 is a side sectional view of the light projecting unit 1, illustrating the three types of light rays generated from the surface of the phosphor light-emitting section 20. These three types of light rays generated from the surface of the phosphor light-emitting section 20 are the following (I) through (III).

(I) Fluorescence emitted by phosphor particles contained in the phosphor light-emitting section 20 being excited by the laser light L1, which is light rays emitted from the phosphor light-emitting section 20 in a Lambertian distribution.

(II) Laser light scattered by the phosphor light emitting section 20, which is light rays emitted from the phosphor light-emitting section 20 in a Lambertian distribution.

(III) Laser light specularly reflected at the surface of the phosphor light-emitting section 20, which is light rays reflected at the surface of the phosphor light-emitting section 20 and advancing in accordance with the law of reflection. This light specularly reflected at the surface of the phosphor light-emitting section 20 will be referred to as reflected light L2.

With regard to the light rays I and II, only light out of the emitted light that is in the range of θ1+θ2 in FIG. 2, which is a range where the projecting member 110 is in line of sight from the emission point E of the phosphor light-emitting section 20, is reflected at the projecting member 110 and contributes to projection. Light that is reflected at the projecting member 110 and contributes to projection will be referred to as illumination light L3.

The reflected light L2 generated by specular reflection of the laser light L1 that is excitation light at the surface of the phosphor light-emitting section 20 is reflected within a range of θ4-θ3 in FIG. 2. The reflected light L2 is laser light itself that has been emitted from the semiconductor laser unit 10, and accordingly needs to be kept from being emitted to the outside of the light source device 100.

Now, a perpendicular line V in FIG. 2 is a perpendicular line as to the surface of the phosphor light-emitting section 20. θ1 and θ2 are angles of line of sight of the projecting member 110 from the emission point E, and are angles from the perpendicular line V. The projecting member 110 projects only light rays emitted over the range of θ1 and θ2 from the emission point E in the Z direction in FIG. 2. The window portion 30 is provided with a transparent region where only light rays emitted over the range of θ1 and θ2 are extracted to the outside of the light source device 100 via the window portion 30.

The incident angle of the laser light L1 to the phosphor light-emitting section 20 is set to an angle where reflected light 12 is not emitted in the range of θ1 and θ2. The reflected light L2 is reflected at a reflection angle as to the perpendicular line V that is equal to the incident angle of the laser light L1 as to the phosphor light-emitting section 20, so θ3 that is the angle of the reflected light 12 as to the perpendicular line V is set to be larger than θ1. An absorption portion 31 is provided to the window portion 30 over an angular range of θ4-θ3, which is the range where the reflected light L2 is emitted. The absorption portion 31 is configured integrally with the window portion 30, of a member that absorbs light.

Note that it is sufficient for the window portion 30 to be provided with a functional portion having a function of preventing external leakage of the reflected light 12 over the angular range of θ4-θ3 where the reflected light L2 is emitted, and that this functional portion is not restricted to a configuration that is the absorption portion 31 made of a member that absorbs light. Accordingly, this functional portion will also be referred to as a light leakage prevention portion 600. Other configuration examples of the light leakage prevention portion 600 will be described later.

Figure 3:
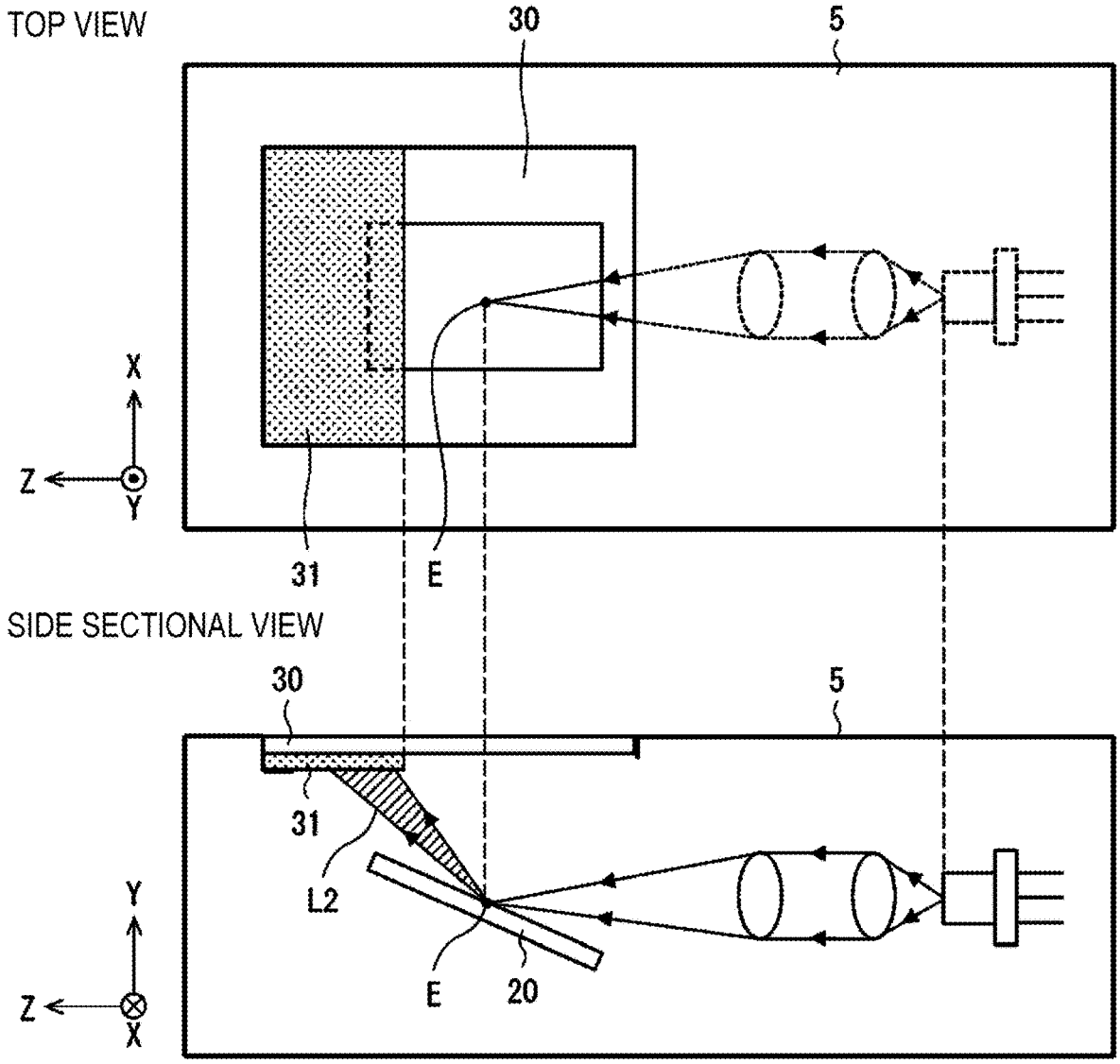
FIG. 3(*a*) is a top view of a light source device, and (*b*) is a side sectional view of the light source device.

(a) in FIG. 3 is a top view of the light source device 100, and (b) in FIG. 3 is a side sectional view of the light source device 100. A rectangular hole is formed in the upper surface of the housing 5 above the phosphor light-emitting section 20, when viewing the light source device 100 from above (Y direction in (a) in FIG. 3), as illustrated in (a) in FIG. 3, and a transparent member that makes up the window portion 30 is provided at the position of this hole. Also, the absorption portion 31 that inhibits laser light reflected at the surface of the phosphor light-emitting section 20 from leaking to the outside through the window portion 30 is provided at part of the window portion 30. Also, the window portion 30 and absorption portion 31 are disposed spaced away from a first surface 21 of the phosphor light-emitting section 20 (the surface at the side where laser light L1 is excited), as illustrated in (b) in FIG. 3. Note that in the following description, the first surface 21 will also be referred to as the surface of the phosphor light-emitting section 20.

The absorption portion 31 is provided at the front side (+Z direction side in (a) in FIG. 3) of the window portion 30, and is provided across the width direction (X direction in (a) in FIG. 3) of the window portion 30. The absorption portion 31 is configured by, for example, coating the window portion 30 made of a transparent member such as glass, sapphire, plastic, or the like, with a member having extremely high absorbency, such as carbon nanotubes or the like. Thus, the absorption portion 31 has a function of preventing reflected light L2 from leaking to the outside of the light source device 100 from the window portion 30, by absorbing light with its extremely sigh absorbency.

Note that the absorption portion 31 is preferably configured by coating a member having extremely high absorbency, such as carbon nanotubes or the like, on the surface of the window portion 30 that is closer to the phosphor light-emitting section 20 (surface on the side facing the phosphor light-emitting section 20). The absorption portion 31 may also be configured by providing a light absorbing member to both surfaces of the upper and lower surfaces of the window portion 30. Also, the absorption portion 31 may be configured by providing a light absorbing member on the surface of the window portion 30 on the side that is farther from the phosphor light-emitting section 20, and providing means for suppressing reflection of light at the surface of the window portion 30 on the side that is closer to the phosphor light-emitting section 20.

The absorption portion 31 is also not restricted to being configured by providing a light absorbing member on part of the surface of the window portion 30 by coating or applying at a later time. The absorption portion 31 may be integrally provided to the window portion 30, by integrally molding a member that absorbs light with the transparent member of which the window portion 30 is made. The absorption portion 31 may also be configured by providing a structure that absorbs light inside the transparent member, by carbon nanotubes being contained in part of the inside of the transparent member making up the window portion 30, or the like.

Thus, the absorption portion 31 may have a configuration where a light absorbing layer is provided on part of the surface of the window portion 30, or may have a configuration where part of the inside of the window portion 30 contains a light absorbing matter. The absorption portion 31 may also have a configuration of being integrally molded with another part of the window portion 30.

According to the present embodiment, the absorption portion 31 that can inhibit laser light which has been specularly reflected at the surface of the phosphor light-emitting section 20, from leaking to the outside through the window portion 30 is provided to part of the window portion 30, so laser light can be prevented from leaking to the outside, with regard to the reflective type light source device 100.

[Modification]

Figure 4:
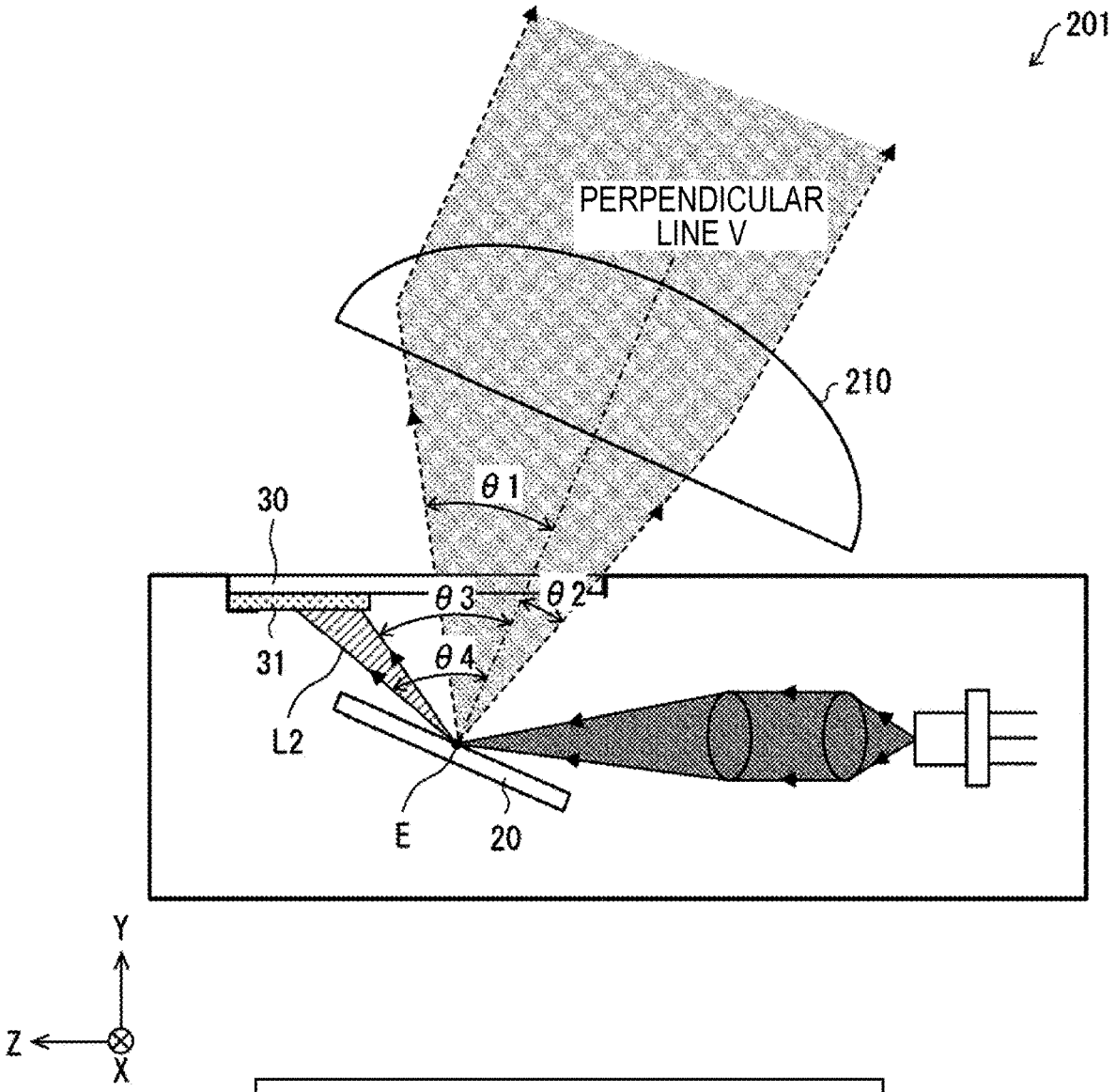
FIG. 4 is a side sectional view illustrating a schematic configuration of a light projecting unit according to a modification.

FIG. 4 is a side sectional view illustrating an overview configuration of a light projecting unit 201 according to a modification. The light projecting unit 201 may have a configuration including a projecting member 210 that is a lens, instead of the projecting member 110 that is a reflector, as illustrated in FIG. 4. Thus, the light projecting member is not restricted to being a reflector and may be a lens.

In the light projecting unit 201 using a lens as the projecting member 210, the projecting member 210 can be disposed such that the position irradiated with the laser light L1 for excitation on the first surface 21 of the phosphor light-emitting section 20 is the emission point E, and the direction of the perpendicular line V set at that point is the direction of projection of light by the lens. The absorption portion 31 is preferably disposed in the window portion 30 so as to have both a function of stopping, out, of the white light emitted from the emission point E, white light that does not enter the projecting member 210, and a function of absorbing the reflected light L2.

Embodiment 2

Embodiment 2 of the present invention will be described below. Note that for the sake of convenience in description, members having the same functions as members described in the above-described Embodiment 1 are denoted by the same symbols, and description thereof will not be repeated.

Figure 5:
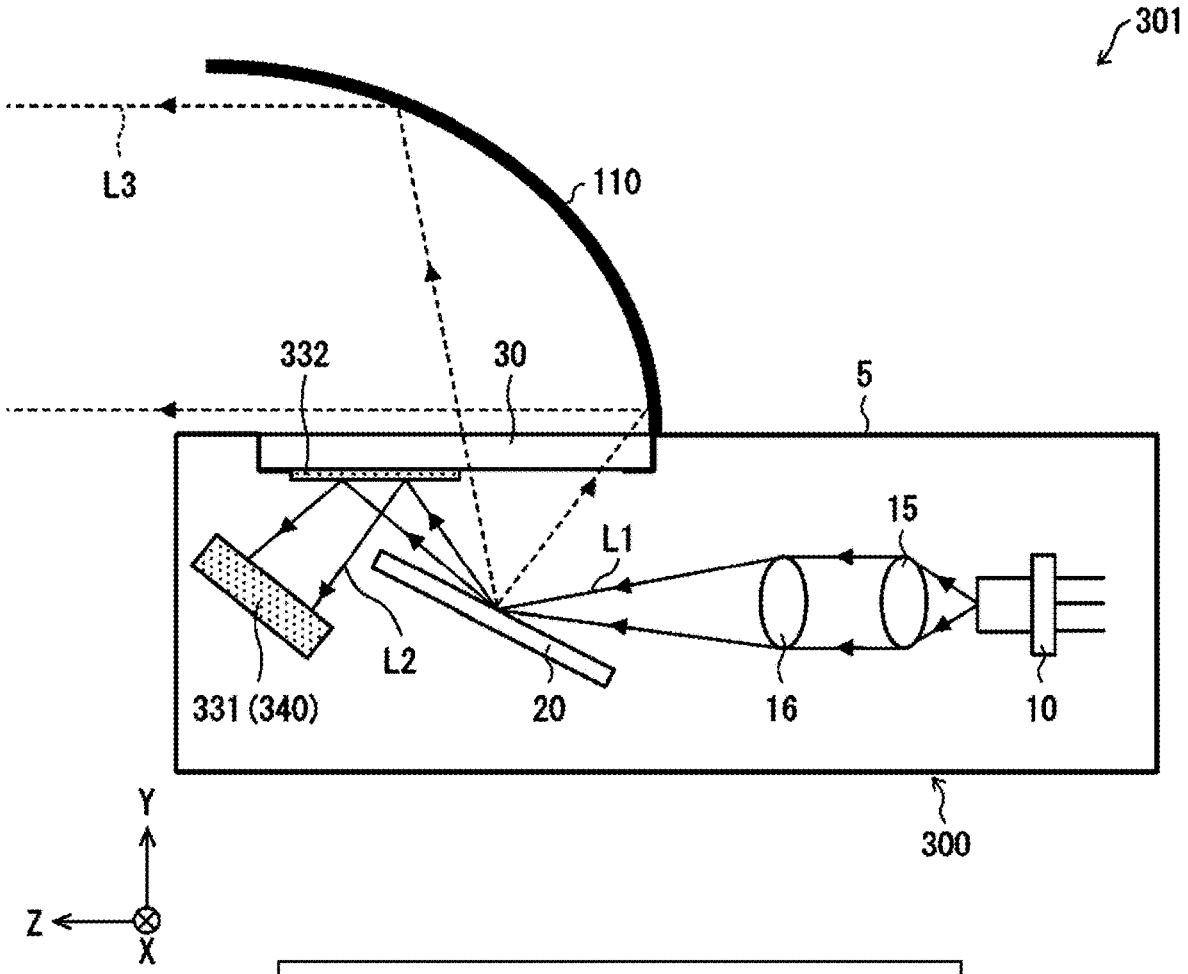
FIG. 5 is a side sectional view illustrating a schematic configuration of a light projecting unit according to Embodiment 2.

FIG. 5 is a side sectional view illustrating an overview configuration of a light projecting unit 301 according to Embodiment 2. The light leakage prevention portion 600 provided to the window portion 30 may be a reflecting portion 332 that reflects the laser light L1 reflected at the first surface 21 of the phosphor light-emitting section 20, as illustrated in FIG. 5.

The reflecting portion. 332 is configured by vapor deposition, or adhesion by some other means, of a material that reflects blue laser light with high reflectance such as aluminum, silver, or the like, or of a dielectric multilayer film or the like that reflects laser light, to part of the window portion 30. The reflected light L2 that is laser light specularly reflected at the surface of the phosphor light-emitting section 20 is radiated onto the reflecting portion 332 and reflected, and advances in a direction toward the inside of the housing 5. Accordingly, the reflecting portion 332 can prevent the reflected light L2 from leaking to the outside of the housing 5 from the transparent region of the window portion 30.

A light source device 300 may be provided with a spaced absorption portion 331 that is configured of a member that absorbs light, disposed inside the housing 5 in a direction in which the reflected light L2 reflected at the reflecting portion 332 is directed, as illustrated in FIG. 5. The spaced absorption portion 331 is disposed at a position spaced away from the window portion 30. The spaced absorption portion 331 cannot absorb 100% of the light reflected by the reflecting portion 332, and part of the light scatters on the inside of the housing 5. Accordingly, the spaced absorption portion 331 preferably is disposed at a position on a deep side of the housing 5, as far as possible from the transparent region of the window portion 30. Disposing the spaced absorption portion 331 spaced away from the window portion 30 can yield effects where stray light emitted from the window portion 30 can be eliminated from the light reflected by the reflecting portion 332.

Figure 6:
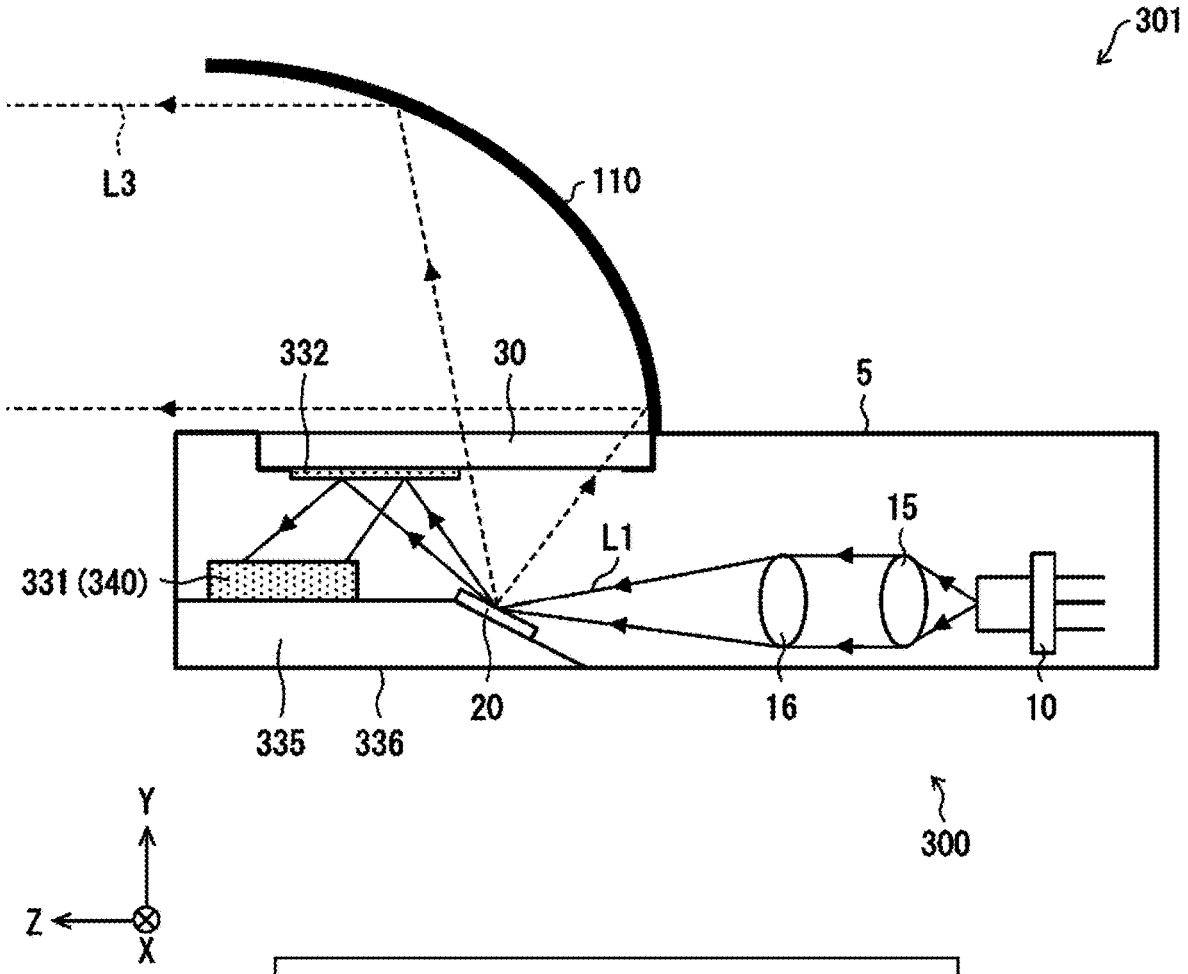
FIG. 6 is a diagram illustrating an example of a heat exhaust structure of the light projecting unit according to Embodiment 2.

Note that generally, members that absorb light hold heat upon absorbing light. Accordingly, the spaced absorption portion 331 preferably is disposed at a position in the housing 5 that has excellent heat exhausting characteristics. For example, a heat exhaust member 335 like a metal thermal dissipation block or the like of aluminum, copper, or the like, may be provided on the rear surface of the phosphor light-emitting section 20, as illustrated in FIG. 6. Heat exhaust of the spaced absorption portion 331 can also be performed without increasing the parts by disposing the spaced absorption portion 331 on a heat exhaust member 335 shared with the phosphor light-emitting section 20.

The phosphor light-emitting section 20 and spaced absorption portion 331 preferably are disposed on the heat exhaust member 335 in close contact. A bottom surface 336 of the housing 5 may be provided with a cooling member, such as heat exhaust fins, an air-cooling fan, a water-cooling member, a Peltier cooler, or the like. Further, a configuration, omitted from illustration, may be made where the semiconductor laser unit 10 is thermally connected to the heat exhaust member 335 in common with the phosphor light-emitting section 20, or to a separate independent heat exhaust member, to enable promotion of heat exhausting of the semiconductor laser unit 10.

Thus, the reflecting portion 332 may be of a configuration having a reflecting layer provided on part of the surface of the window portion 30. Also, the light source device 300 may be of a configuration having the spaced absorption portion 331 that absorbs laser light reflected by the reflecting portion 332.

According to the present embodiment, the reflecting portion 332 that can inhibit laser light specularly reflected at the surface of the phosphor light-emitting section 20 from leaking to the outside through the window portion 30 is provided to part of the window portion 30, so external leakage of laser light can be prevented in the reflective type light source device 100.

Modification of Embodiment 2

An example has been described in the above Embodiment 2 where the spaced absorption portion 331 configured of a member that absorbs light is provided in the direction in which the reflected light 12 reflected by the reflecting portion 332 is directed. However, this is not restrictive, and the light source device 300 may be provided with a spaced photoreceptor 340 configured of an electronic device that performs photoelectric conversion of light instead of the spaced absorption portion 331, as illustrated in FIG. 5.

Specific examples that can be used for the spaced photoreceptor 340 include image sensors such as CMOS or CCD, and so forth, besides photodiodes, phototransistors, and CdS (cadmium sulfide cells). The spaced photoreceptor 340 is disposed at a position spaced away from the window portion 30. The spaced photoreceptor 340 receives light reflected by the reflecting portion 332, and thereby outputs the intensity of that light as electric signals. The spaced photoreceptor 340 preferably is disposed at a position on the deep side of the housing 5, as far as possible from the transparent region of the window portion 30. Disposing the spaced photoreceptor 340 spaced away from the window portion 30 can yield effects where stray light emitted from the window portion 30 can be reduced from the light reflected by the reflecting portion 332.

Note that generally, devices that receive light hold heat upon receiving light. Accordingly, the spaced photoreceptor 340 preferably is disposed at a position in the housing 5 that has excellent heat exhausting characteristics (see FIG. 6).

Thus, the light source device 300 may be of a configuration having the spaced photoreceptor 340 that receives laser light reflected by the reflecting portion 332. The light received by the spaced photoreceptor 340 is part of the laser light emitted from the semiconductor laser unit 10, and the electrical output of the spaced photoreceptor 340 is proportionate to the output of the semiconductor laser unit 10. That is to say, output of the semiconductor laser unit 10 can be monitored at the spaced photoreceptor 340.

Also, light that enters the spaced photoreceptor 340 is laser light that has been reflected at the phosphor light-emitting section 20 being received, so in a case where there is an abnormality occurring at the phosphor light-emitting section 20, the proportional relation of the electrical output of the spaced photoreceptor 340 as to the output of the semiconductor laser unit 10 is disrupted, and exhibits abnormal values. That is to say, the state of the phosphor light-emitting section 20 can be monitored at the spaced photoreceptor 340. Abnormalities of which occurrence can be assumed at the phosphor light-emitting section 20 here include defects, displacement, deformation due to deterioration or the like, and so forth, of the phosphor light-emitting section 20.

According to the present modification, the light source device 300 has the spaced photoreceptor 340 that receives laser light reflected by the reflecting portion 332, and outputs intensity of the light as electric signals. According to this configuration, stray light emitted from the window portion 30 can be reduced from the light reflected by the reflecting portion 332. Also, abnormalities at the phosphor light-emitting section 20 can be detected by monitoring the relation of the output of the spaced photoreceptor 340 as to the output of the semiconductor laser unit 10.

Embodiment 3

Embodiment 3 of the present invention will be described below. Note that for the sake of convenience in description, members having the same functions as members described in the above-described Embodiment 1 are denoted by the same symbols, and description thereof will not be repeated. Also, the configuration of a light projecting unit according to Embodiment 3 is the same as the light projecting unit 1 according to Embodiment 1 described with reference to FIG. 1, except for the configuration of the window portion 30, so description thereof will be omitted.

Figure 7:
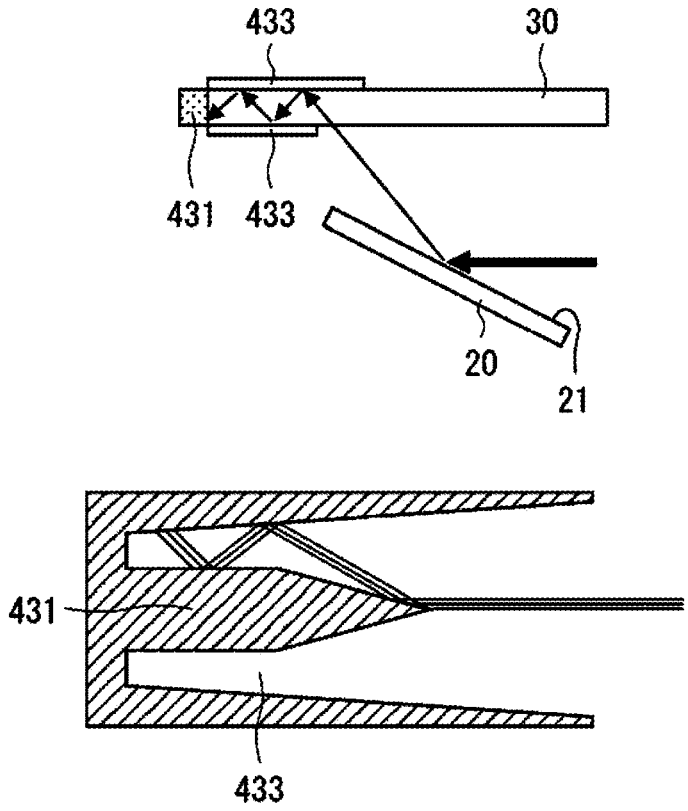
FIG. 7(*a*) is a partial enlarged view illustrating a schematic configuration of a window portion and a phosphor light-emitting section according to Embodiment 3, and (*b*) is a partial enlarged view illustrating a modification of a configuration of a light guide portion and absorption portion.

(a) in FIG. 7 is a partial enlarged view illustrating a schematic configuration of the window portion 30 and phosphor light-emitting section 20. The light leakage prevention portion 600 provided to the window portion 30 may be a light guide portion 433 that guides laser light reflected at the first surface 21 of the phosphor light-emitting section 20, as illustrated in (a) of FIG. 7.

The light guide portion 433 is configured by providing a reflecting member on part of both surfaces of the front surface and rear surface of the transparent plate-shaped window portion 30. The front surface of the window portion 30 means the surface facing the outside of the housing 5, and the rear surface of the window portion 30 means the surface facing the inside of the housing 5. The light guide portion 433 is configured by vapor deposition, or adhesion by some other means, of a material that reflects blue laser light with high reflectance such as aluminum, silver, or the like, to part of the front surface and rear surface of the window portion 30. The light guide portion 433 has a function of preventing the reflected light L2 from leaking to the outside of the housing 5 from the transparent region of the window portion 30, by guiding the reflected light L2, where laser light has been specularly reflected at the surface of the phosphor light-emitting section 20, to an absorption portion 431.

The absorption portion 431, made up of a light absorbing material that absorbs the reflected light L2 guided through the interior of the transparent member of the window portion 30 by the light guide portion 433, is disposed at the front end portion of the window portion 30. The absorption portion 431 may be formed by providing a material that absorbs light, such as carbon nanotubes or the like for example, to the end portion of the window portion 30 by coating or the like.

The light guide portion 433 can efficiently guide the reflected light L2 through the interior of the transparent member of the window portion 30 to the absorption portion 431, by the dimensions of the reflecting member provided on the front surface and rear surface of the window portion 30 having been controlled. Thus, the reflected light L2 can be dissipated at the end portion of the window portion 30 by guiding the reflected light L2 to the absorption portion 431 by the light guide portion 433.

In this way, reflected light L2 that has been specularly reflected at the surface of the phosphor light-emitting section 20, and that is undesirable to be emitted to the outside of the housing 5, can be guided through the interior of the window portion 30 by the light guide portion 433 and dissipated at the absorption portion 431 in the light projecting unit according to Embodiment 3. Accordingly, the reflected light L2 can be prevented from leaking to the outside of the housing 5 from the transparent region of the window portion 30.

(b) in FIG. 7 is a partial enlarged view illustrating a modification of the configuration of the light guide portion 433 and absorption portion 431. The absorption portion 431 may be provided in the interior of the transparent member, by including carbon nanotubes in part of the interior of the transparent member configuring the window portion 30, or the like, as illustrated in (b) in FIG. 7. In this case, the absorption portion 431 may be provided such that the reflected light L2 being directed toward the tip of the window portion 30 through the light guide portion 433 is gradually absorbed by the absorption portion 431 with each reflection.

Thus, the light guide portion 433 may be of a configuration having a reflecting layer provided on part of the front surface and rear surface of the window portion 30. Also, the light source device 100 may be of a configuration having the absorption portion 431 that absorbs light guided by the light guide portion 433, at an end portion of part of the window portion 30.

According to the present embodiment, the light guide portion 433 that can inhibit laser light specularly reflected at the surface of the phosphor light-emitting section 20 from leaking to the outside through the window portion 30 is provided to part of the window portion 30, so external leakage of laser light can be prevented in the reflective type light source device 100.

Embodiment 4

Embodiment 4 of the present invention will be described below. Note that for the sake of convenience in description, members having the same functions as members described in the above-described Embodiment 1 are denoted by the same symbols, and description thereof will not be repeated. Also, the configuration of a light projecting unit according to Embodiment 4 is the same as the light projecting unit 1 according to Embodiment 1 described with reference to FIG. 1, except for the configuration of the window portion 30, so description thereof will be omitted.

FIG. 8 is a partial enlarged view illustrating a schematic configuration of the window portion 30 and phosphor light-emitting section 20. The light leakage prevention portion 600 provided to the window portion 30 may be a scattering portion 534 that scatters laser light reflected at the first surface 21 of the phosphor light-emitting section 20, as illustrate in FIG. 8.

The scattering portion 534 is configured having a scattering structure provided at part of the rear surface of the transparent plate-shaped window portion 30. The scattering structure can be formed by physically coarsening part of the rear surface of the window portion 30 to yield a ground-glass-like form, applying a film including a scattering member to part of the rear surface of the window portion 30, or the like. A reflecting structure that reflects light, or an absorbing structure that absorbs light, is provided on the front surface of the window portion 30 at the scattering portion 534.

Of the laser light specularly reflected at the surface of the phosphor light-emitting section 20, light being directed toward the scattering portion 534 is scattered by the scattering structure of the scattering portion 534, and is diffused. Also, of the light scattered by the scattering structure of the scattering portion 534, light being directed toward the front surface of the window portion 30 is either returned to the inside of the housing 5 by the reflecting structure, or absorbed by the absorbing structure. Accordingly, light scattered by the scattering structure of the scattering portion 534 can be suppressed from being emitted to the outside of the housing 5 from the window portion 30 and affecting illumination light.

In this way, according to the present embodiment, light that has been specularly reflected at the surface of the phosphor light-emitting section 20, and that is undesirable to be emitted to the outside of the housing 5, can be reduced by scattering within the scattering portion 534 provided to the window portion 30. Also, light Scattered within the scattering portion 534 is reflected or diffused inside the housing 5 as stray light, and thus can be prevented from being emitted to the outside of the housing 5.

In this way, the scattering portion 534 may be of a configuration having a scattering structure at part of the window portion 30, on one surface facing the first surface 21 of the phosphor light-emitting section 20, and having a reflecting structure that reflects laser light on the other surface of part of the window portion 30. Alternatively, the scattering portion 534 may be of a configuration having a scattering structure at part of the window portion 30, on one surface facing the first surface 21 of the phosphor light-emitting section 20, and having an absorbing structure that absorbs laser light on the other surface of part of the window portion 30. Note that the scattering structure of the scattering portion 534 may be a ground-glass-like structure provided on part of the surface of the window portion 30, or may be a scattering layer such as a film or the like containing a scattering member, that is provided on part of the surface of the window portion 30.

According to the present embodiment, the scattering portion 534, which inhibits laser light specularly reflected at the surface of the phosphor light-emitting section 20 from leaking to the outside via the window portion 30, is provided to part of the window portion 30, so external leakage of laser light can be prevented in the reflective type light source device 100.

[Regarding Configuration of Light Leakage Prevention Portion 600]

The light leakage prevention portion 600 is configured of at least one of, or a combination of the absorption portion 31 that absorbs laser light specularly reflected at the surface of the phosphor light-emitting section 20 the reflecting portion 332 that reflects laser light specularly reflected at the surface of the phosphor light-emitting section 20 the light guide portion 433 that guides laser light specularly reflected at the surface of the phosphor light-emitting section 20 the scattering portion 534 that scatters laser light specularly reflected at the surface of the phosphor light-emitting section 20 as described in the above Embodiments 1 through 4.

Now, rays of the laser light specularly reflected at the surface of the phosphor light-emitting section 20 advance from the surface of the phosphor light-emitting section 20 following the law of reflection, as described earlier. However, the surface of the phosphor light-emitting section 20 is not necessarily a perfect mirror surface, and may have unevenness. There are also cases where the surface of the phosphor light-emitting section 20 is intentionally coarsened, in order to reduce light that is specularly reflected at the surface of the phosphor light-emitting section 20.

FIG. 9 is a diagram illustrating the spread of light regarding which emit to the outside of the housing 5 is undesirable, out of the light being directed toward the window portion 30 from the surface of the phosphor light-emitting section 20. In a case where the surface of the phosphor light-emitting section 20 is uneven, or in a case where the surface of the phosphor light-emitting section 20 has been intentionally coarsened, the laser light is not necessarily completely specularly reflected at the surface of the phosphor light-emitting section 20. In such a case, spreading of the laser light specularly reflected at the surface of the phosphor light-emitting section 20 occurs ($\beta_{RB}$ in FIG. 9) due to surface scattering, where light scatters at the surface of the phosphor light-emitting section. 20, as illustrated in FIG. 9.

Accordingly, the Z-direction width of the light Leakage prevention portion 600 (see FIG. 10) at the window portion 30 needs to be set taking into consideration effects of the spread of reflected light by surface scattering at the phosphor light-emitting section 20. (a) through (d) in FIG. 10 are diagrams illustrating layout configurations of the light leakage prevention portion 600 at the window portion 30, and are top views of the window portion 30.

Figure 10:
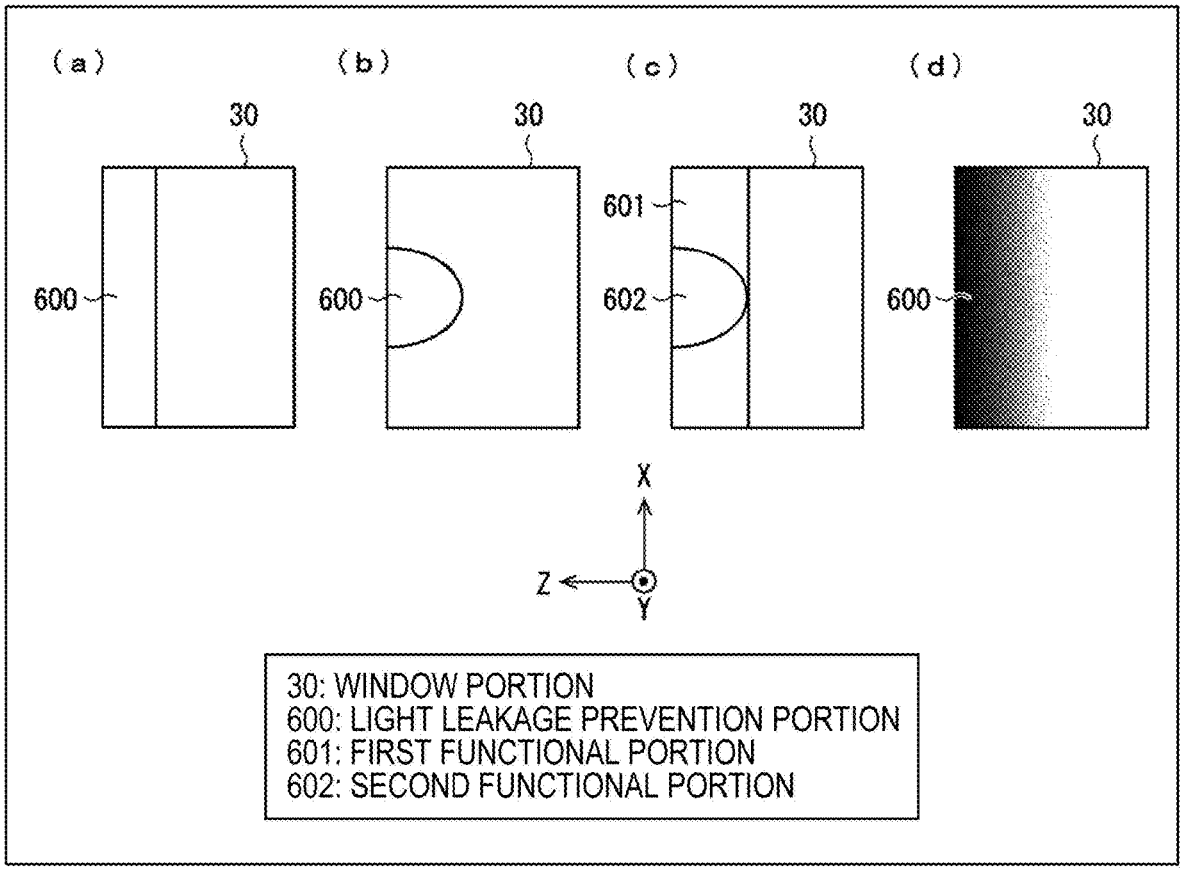
FIG. 10(*a*) through (*d*) are diagrams illustrating examples of layout configurations of a light leakage prevention portion.

In the above Embodiment 1, a configuration has been described where the light leakage prevention portion 600 is provided uniformly across the X direction, at the +Z direction end portion of the window portion 30, as illustrated in (a) in FIG. 10. On the other hand, the layout configuration of the light leakage prevention portion 600 is not restricted to this.

Laser light specularly reflected at the surface of the phosphor light-emitting section 20 has a spot shape, even if spreading due to scattering is taken into consideration. Accordingly, it is sufficient for the light leakage prevention portion 600 to be provided only to at least a portion where reflected light from surface scattering at the phosphor light-emitting section 20 strikes, as illustrated in (b) in FIG. 10, and does not necessarily have to be uniformly provided across the X direction of the window portion 30.

Also, there are cases where the light leakage prevention portion 600 has functions of suppressing laser light specularly reflected at the surface of the phosphor light-emitting section 20 from being externally emitted, while shielding components of light excited at the pronouncement of the phosphor light-emitting section 20 that do not strike the projecting member 110, as described above. An example of a light leakage prevention portion 600, provided with a first functional portion 601 having a function of shielding components that do not strike the projecting member 110, and a second functional portion 602 having functions of suppressing laser light specularly reflected at the surface of the phosphor light-emitting section 20 from being externally emitted, in this way, illustrated in (c) in FIG. 10.

The light leakage prevention portion 600 illustrated in (c) in FIG. 10 has the first functional portion 601 that includes a reflective material, and the second functional portion 602 that includes a light absorbing material. Note that a configuration may also be made where the first functional portion 601 includes a reflective material, and the second functional portion 602 includes a light absorbing material, or a configuration may be made where the first functional portion 601 and the second functional portion 602 each have light absorbing materials or reflective materials that are materials that differ from each other. Further, at least one of the first functional portion 601 and the second functional portion 602 may be imparted with light guide functions or scattering functions.

Also, the light leakage prevention portion 600 does not have to have an abrupt boundary with the transparent region of the window portion 30, and a configuration may be made where characteristics change gradually or in steps, as illustrated in (d) in FIG. 10. Note that the boundary between the light leakage prevention portion 600 and the transparent region of the window portion 30 does not have to be a straight line, and may be a curve or any other shape.

Note that the light leakage prevention portion 600 may be of any shape, material, and configuration that will optimize functions that are desired to be realized. It is needless to say that the layout configurations of the light leakage prevention portion 600 illustrated in (a) through (d) in FIG. 10 can be applied to the light leakage prevention portion 600 in the above-described Embodiments 1 through 4.

REFERENCE SIGNS LIST

1, 201, 301 light projecting unit
5 housing
10 semiconductor laser unit
20 phosphor light-emitting section
21 first surface
30 window portion
31, 431 absorption portion
100 light source device
331 spaced absorption portion (absorption portion)
332 reflecting portion
340 spaced photoreceptor (photoreceptor)
433 light guide portion
534 scattering portion
600 light leakage prevention portion (functional portion)

The invention claimed is:

1. A light source device, comprising:

a semiconductor laser unit; and a phosphor light-emitting section excited by laser light emitted from the semiconductor laser unit, wherein the laser light excites a first surface of the phosphor light-emitting section, a window portion formed of a transparent member is provided spaced away from the first surface, the transparent member transmitting the laser light and phosphor light emitted from the phosphor light-emitting section, and a scattering portion, which scatters the laser light, is provided to part of the window portion, the scattering portion being provided at a position so as to inhibit, out of the laser light incident on the first surface of the phosphor light-emitting section, laser light that has been specularly reflected at the first surface of the phosphor light-emitting section, and the scattering portion being in contact with the part of the window portion, the scattering portion has a scattering structure on a surface of part of the window portion that faces the first surface of the phosphor light-emitting section, and has an absorbing structure that absorbs the laser light on another surface of part of the window portion.

* * * * *